United States Patent [19]

Lowry, III et al.

[11] Patent Number: 4,979,553

[45] Date of Patent: Dec. 25, 1990

[54] SLAT ASSEMBLY AND CURTAIN FOR ROLLING DOOR

[75] Inventors: John A. Lowry, III, Columbus; Rajendra Singh, Dublin, both of Ohio

[73] Assignee: Wayne-Dalton Corporation, Mt. Hope, Ohio

[21] Appl. No.: 308,807

[22] Filed: Feb. 10, 1989

[51] Int. Cl.[5] ..... E06B 9/10

[52] U.S. Cl. ..... 160/133; 160/232; 160/235; 160/236

[58] Field of Search ..... 160/133, 236, 235, 232, 160/233, 234, 23.1, 41, 32, 33

[56] References Cited

U.S. PATENT DOCUMENTS

| | | | |
|---|---|---|---|
| 700,873 | 5/1902 | Wilson | 160/236 |
| 880,701 | 3/1908 | Vance | 160/232 |
| 1,054,977 | 3/1913 | McCloud | 160/235 |
| 1,095,152 | 4/1914 | Volp | 160/232 |
| 3,090,430 | 5/1963 | Carlo . | |
| 3,967,671 | 7/1976 | Stanley et al. . | |
| 4,156,448 | 5/1979 | Bengtsson | 160/232 |
| 4,368,772 | 1/1983 | Bouthillier . | |
| 4,379,480 | 4/1983 | Kempel et al. . | |
| 4,436,136 | 3/1984 | Downey | 160/232 |
| 4,467,853 | 8/1984 | Downey | 160/41 X |
| 4,567,931 | 2/1986 | Wentzel . | |
| 4,628,982 | 12/1986 | Labelle | 160/232 X |
| 4,630,664 | 12/1986 | Magro | 160/232 |

FOREIGN PATENT DOCUMENTS

| | | | |
|---|---|---|---|
| 1659464 | 10/1969 | Fed. Rep. of Germany | 160/235 |
| 2808177 | 8/1979 | Fed. Rep. of Germany | 160/235 |
| 3402532 | 8/1985 | Fed. Rep. of Germany . | |
| 1385298 | 12/1964 | France . | |
| 2531137 | 2/1984 | France | 160/236 |
| 2555243 | 5/1985 | France | 160/236 |
| 2141769 | 1/1985 | United Kingdom | 160/235 |

*Primary Examiner*—David M. Purol

*Attorney, Agent, or Firm*—Kerkam, Stowell, Kondracki & Clarke

[57] ABSTRACT

An improved slat assembly and curtain for a rolling door assembly employing the improved slat are provided. The slat assembly has a primary slat with a lower bead having a downwardly facing cavity which is used to retain an elastomeric sealing strip which seals the space between adjacent interlocked slats in the curtain. The slat assembly may be provided with a backer slat and material filling a void between the primary slat and backer slat to improve the thermal insulation and/or acoustical insulation and absorption properties of the slat assembly and curtain.

36 Claims, 3 Drawing Sheets

FIG. 2
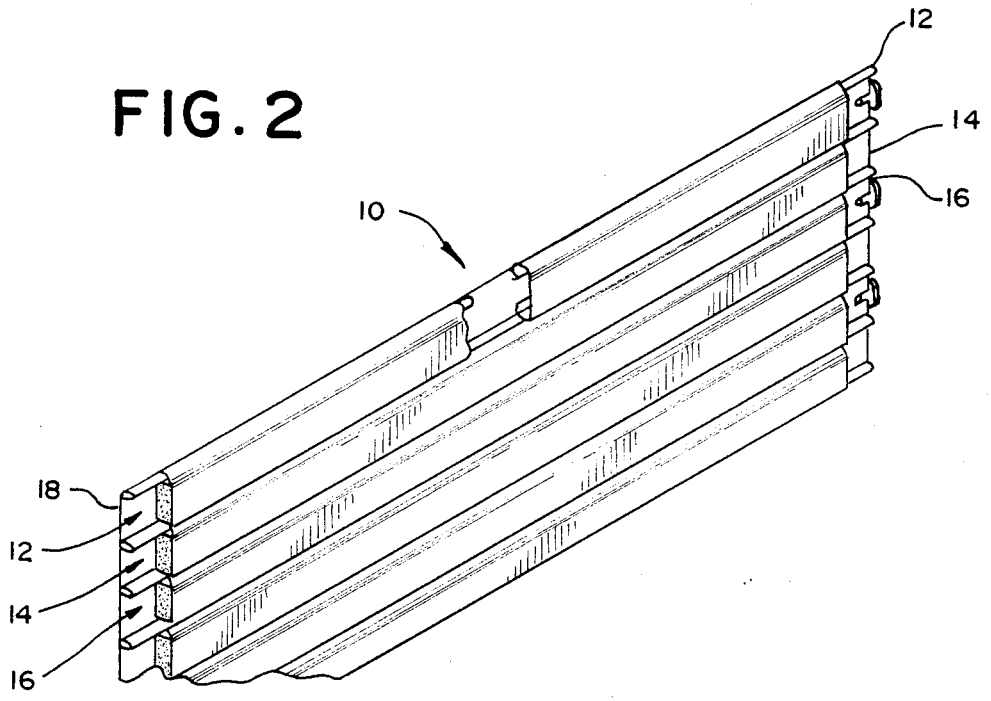
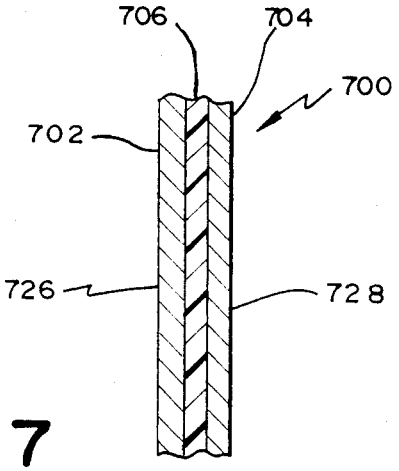
FIG. 7

FIG. 3
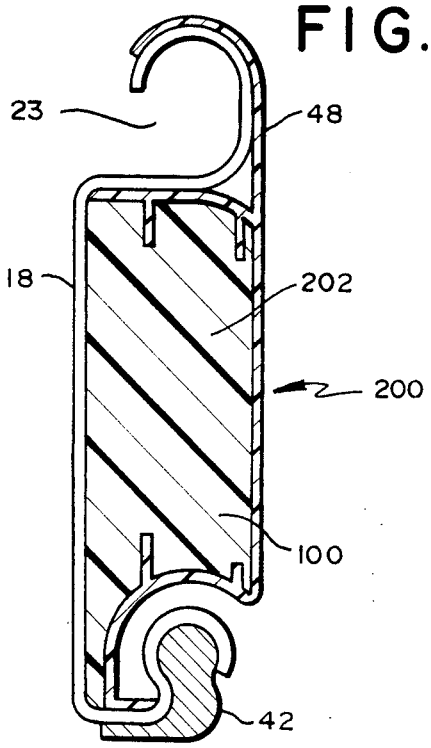
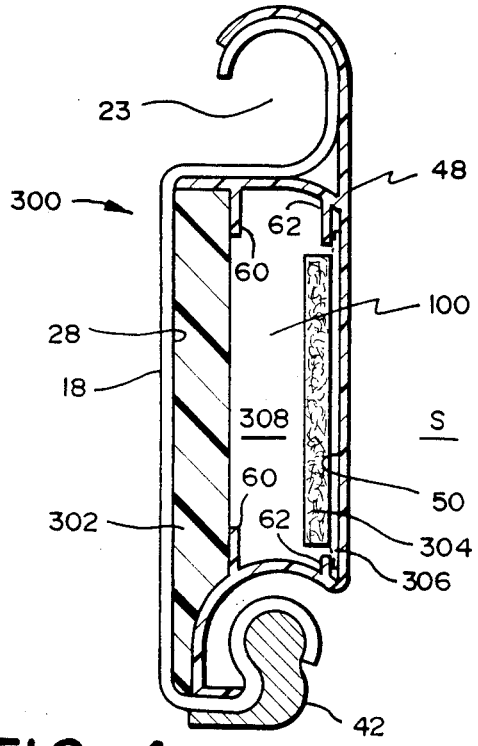
FIG. 4
FIG. 5
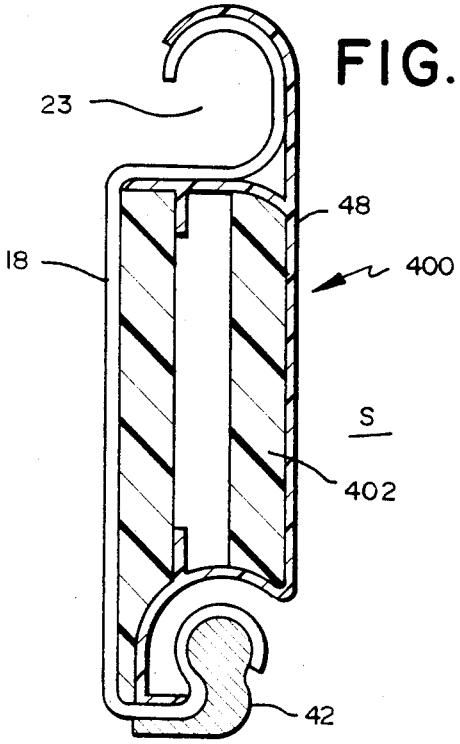
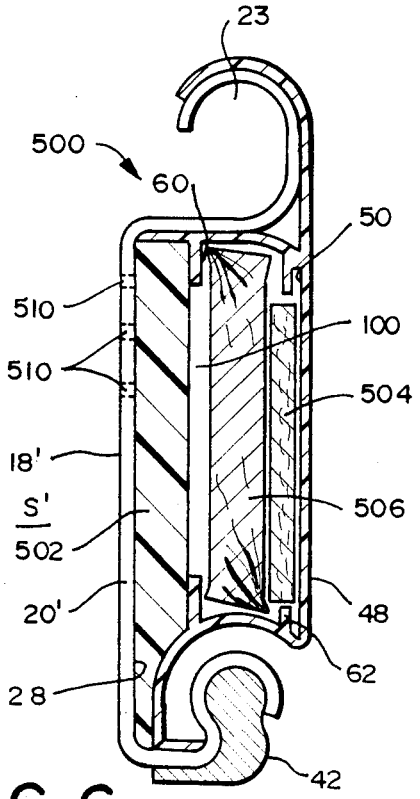
FIG. 6

SLAT ASSEMBLY AND CURTAIN FOR ROLLING DOOR

BACKGROUND OF THE INVENTION

1. Field of the Invention

The present invention relates to rolling doors which employ interlocking, pivoting slats and particularly to an improved slat design for use in such doors which provides the capability to improve the thermal insulation and/or acoustical insulation and absorption properties of the door.

2. Description of the Related Art

U.S. Pat. No. 4,436,136, issued to Downey, Jr., and assigned to the owner of the present invention, discloses an insulated slat for use in a curtain of a rolling steel door, a plurality of these slats forming the curtain and improving the insulative characteristics of the door. This patent is hereby incorporated by reference. The slats in the aforenoted Downey patent employ a vinyl backer slat which holds an insulative material in place at the back of the primary or outer slat. In larger door sizes, this vinyl backer slat suffers from the disadvantage that, when the door is coiled, the vinyl backing of the inner wraps and the insulation held therein may be crushed by the weight of the outer wraps in the coil.

Other slat configurations are known and used in the industry to improve the thermal insulative properties of rolling doors. In some instances, metal backer slats have been employed in order to provide stronger reinforcement at the back side of the slat, however, it is recognized in the art that when metal is used for both the outer curtain slats and their associated backer slats, a solid conduction path from one side of the curtain to the other is provided which detracts from the insulative properties of the door. U.S. Pat. No. 4,368,772 issued to Bouthillier discloses one attempt to improve insulation properties of doors employing metal slats by providing a break in the solid conduction path between the outer and inner metal skins of the sectional door by crimping an insulative material between the metal skins at the point where the skins are joined. Notwithstanding such arrangements which provide a break in the solid conduction path of metal slats, curtains employing vinyl backer slats consistently outperform those having metal backer slats from a thermal insulation standpoint.

The insulative properties of a curtain used in a rolling door are also adversely affected by the amount of air allowed to infiltrate through the joints between the slats wherein an upper bead or curved portion from one slat is interlocked with a lower bead or curved portion of a slat immediately thereabove. Designs have been employed to reduce the air infiltration in slats of this type, including the provision of a gasket seal extending across the length of the slat on an upwardly facing surface of the outer slat. An attendant disadvantage of this design is that the gasket is housed in a recess which faces in a concave upward manner, with the gasket and recess forming an undesirable water trap or collection point for water running down the curtain.

The prior art, in addition to lacking fully satisfactory solutions for improving the thermal insulation properties of curtains employing interlocking slats, also is found to be lacking in providing slat designs which provide desired acoustical characteristics. Various applications exist which may require either reduction of sound transmission or enhancement of sound absorption at a door opening.

It is therefore an important object of the present invention to provide a slat assembly configuration which is capable of being used in curtains of the interlocking slat type having improved thermal insulation characteristics.

It is a further object of the present invention to provide a slat assembly configuration which may be used in a curtain made up of interlocking slats wherein the curtain possesses improved acoustical transmission or absorption characteristics, as required, in a particular service.

It is another object of the present invention to provide a slat for use in a curtain made up of interlocking slats wherein the curtain provides a barrier to smoke infiltration under elevated temperature conditions which would be experienced in fires.

It is another object of the present invention to provide a curtain and a rolling door assembly employing curtain having improved thermal and/or acoustical insulative properties.

SUMMARY OF THE INVENTION

The above and other objects of the present invention are accomplished by the present invention which provides an improved slat assembly adapted for use in an interlocking, pivotable manner with adjacent or neighboring slat assemblies to form a curtain which is employed as an openable barrier in a rolling door assembly. The improved slat of the present invention is of the type having a longitudinally extending web portion and integral upper and lower end curved portions, which may be referred to alternatively as upper and lower beads.

The improved primary slat according to the present invention has a novel bead geometry which enables a curtain to be constructed having improved thermal and/or acoustical properties. The lower bead of the slat is configured to have a downwardly opening cavity adapted to retain a compressible elastomeric strip across the longitudinal extent of the slat at a bottom surface of the slat. The elastomeric strip, when the curtain is in a lowered or uncoiled position, is designed to be in contact with the bottom portion of an upper slat by which it is retained and a top portion of a lower slat adjacent to and immediately below the upper slat.

The elastomeric strip is adapted to maintain the bottom surface of the upper slat and top surface of the lower slat in a spaced apart relation when the curtain is in its uncoiled position, thereby eliminating metal-to-metal contact between the adjacent surfaces. This provides improved thermal insulative performance in that solid conductive paths between slats are short-circuited by the elastomer which has a low thermal conductivity. Further, the elastomeric strip provides a seal in the space between the slats to reduce or substantially eliminate air and water infiltration between the slats. In a similar fashion, the elastomeric strip also acts as an isolation mechanism between the adjacent slats in the curtain to virtually eliminate acoustical transmission from slat to slat along the curtain.

Further improved characteristics provided by the slat assembly of the present invention are recognized in the various embodiments wherein a polyvinyl chloride backer slat is provided which, in combination with the primary slat, defines a hollow cavity or void at an inner portion of the slat. This void may be filled with various materials, depending upon the intended application for the installed door. For example, a foamed-in-place thermally insulative material may be provided, filling the entire cavity in the slat, where improved thermal insulation at the doorway is desired. Various other materials may be employed to improve the acoustical characteristics of the door.

The fire safety characteristics of rolling doors may be improved by employing a plurality of the primary slats in combination with elastomeric sealing strips capable of withstanding high temperatures. The strip, which under normal conditions aids in sealing the curtain against air and water infiltration, will, under elevated temperature conditions, prevent smoke from passing through the joints between the slats in the curtain.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention taken in conjunction with the accompanying drawings wherein like reference characters represent like, parts throughout the several views, and wherein:

FIG. 2 is a diagrammatic rear perspective view of a curtain made up of a plurality of slat assemblies according the present invention;

FIG 3 is a partial cross-sectional view of a slat assembly configured especially for use in a thermally insulated for a rolling door assembly;

FIG. 4 is a partial cross-sectional view of a slat assembly configured especially for use in a curtain providing reduced sound transmission;

FIG. 5 is a partial cross-sectional view of a further embodiment of a slat assembly configured especially for use in a curtain providing reduced sound transmission.

FIG. 6 is a partial cross-sectional view of a slat assembly configured especially for use in providing improved sound absorption; and FIG. 7 is an exploded cross-sectional view depicting a material which may be employed for the primary slat of the slat assembly.

DESCRIPTION OF THE PREFERRED EMBODIMENTS

Figure 1:
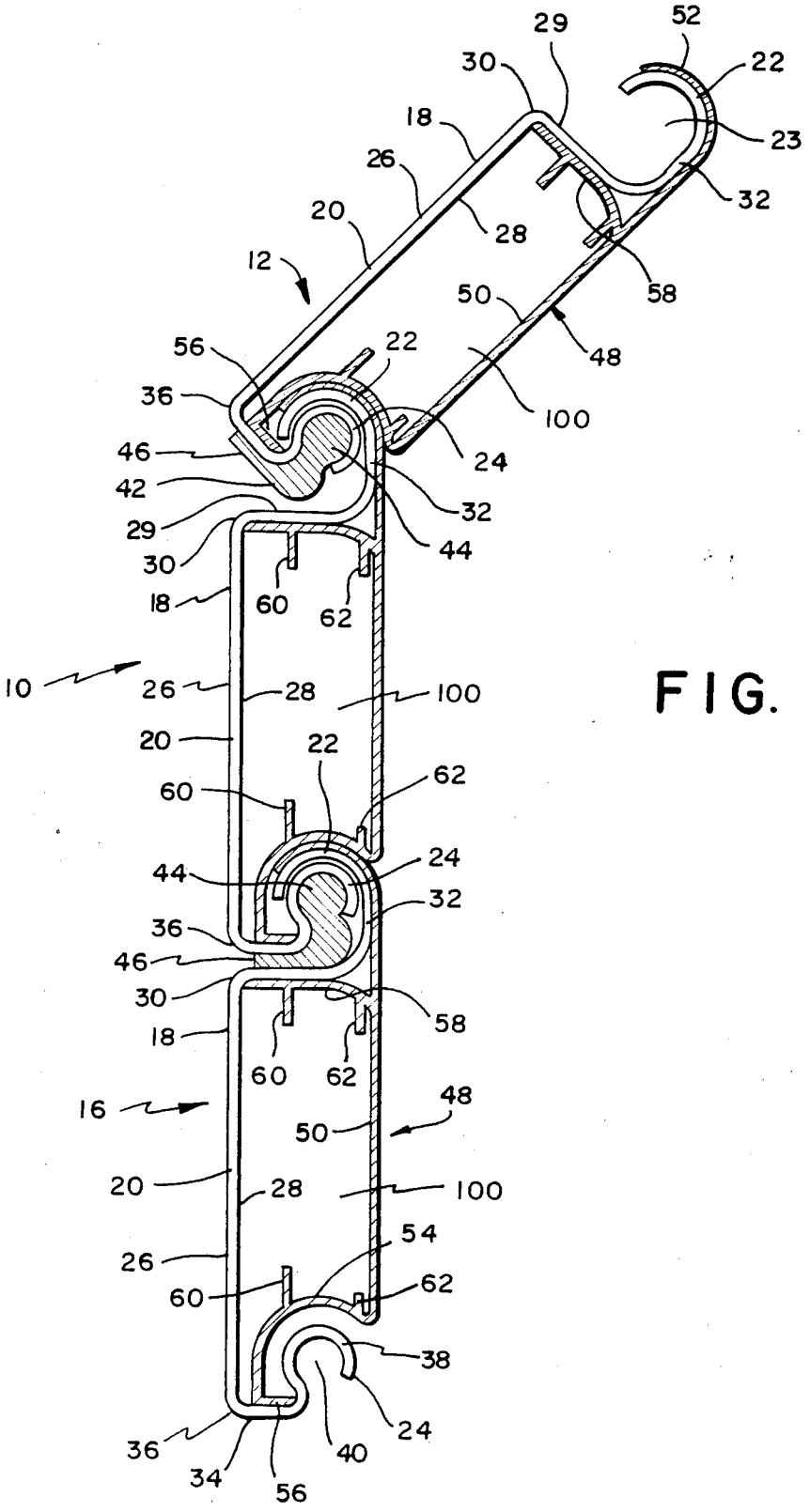
FIG. 1 a side elevation view of three interlocking slat assemblies forming a portion of a curtain for a rolling door according to a preferred embodiment present invention.

Referring initially to FIGS. 1 and 2, the basic construction of a curtain 10 according to a preferred embodiment of the present invention and adapted to be used in a rolling door assembly will be described. The curtain 10 is made up of a plurality of slat assemblies, three of which are depicted in FIG. 1, identified by numerals 12, 14, 16. It is to be recognized that, in actual practice, the curtain will generally be made up of many slat assemblies and only three are depicted in FIG. 1 for simplified descriptive purposes. As can be seen in FIG. 2 the slat assemblies 12, 14, 16 forming the curtain 10 have a longitudinal extent, which in the depicted preferred embodiment extends in a horizontal orientation.

The slat assemblies as depicted in FIG. 1 are each made up of three elements or components. The primary slat 18, preferably made of a metal such as steel or aluminum, has a web portion 20, an integral upper curved portion or upper bead 22, and a lower curved portion or lower bead 24. In this preferred embodiment, the web portion 20 is generally planar in profile, and when the curtain 10 is uncoiled (door closed) the web portions 20 of the plurality of slat assemblies forms a nearly continuous planar surface (see slat assemblies 14, 16 in FIG. 1) across a height and width of the curtain. The web portion 20 of the primary or main slat 18 has an outer surface 26 and an inner surface 28, so termed herein because in most applications the outer surface 26 will be exposed to the exterior environment at a doorway.

The upper beads 22 of the main slats 18 are configured to pivotably engage, in an interlocking manner, the lower beads 24 of the slat assemblies disposed immediately thereabove when the curtain is constructed. The upper bead 22 has a standoff flange 29 which extends inwardly, i.e. away from outer surface 26, from an upper edge 30 of main slat 18, and curves upwardly and around in a direction toward the outer surface. The upper bead 22 has a somewhat similar shape to those previously used in the art, such as that shown in U.S. Pat. No. 4,436,136, however unlike the upper curved portion or bead in that patent, upper bead 22 has an extended, substantially straight extension segment 32 at its most inward extent, defining an inner area 23 of the upper bead 22. The importance of this feature will be discussed in detail later in this description.

The lower beads 24 of the main slats 18 are also configured differently than those previously known in the art. The lower beads in conventional slats generally have substantially the same cross-sectional shape or geometry, albeit a smaller radius of curvature, as the upper beads of the slats, and open toward the inner surface of the main slat, forming an inwardly facing cavity. The bottom of the slats in the prior art have therefore been substantially flat, continuous surfaces. According to a preferred embodiment of the present invention, the lower beads 24 are quite different in cross-sectional shape than the upper beads 22, while maintaining a configuration permitting pivotable engagement of the upper and lower beads 22, 24 of adjacent slats.

As can be seen in any of FIGS. 1, 3, 4, 5 or 6, the lower bead has a standoff flange portion 34 extending substantially perpendicularly inwardly from a lower edge 36 of web 20, the flange being substantially shorter than would be found in a conventional slat, for example like those depicted in U.S. Pat. Nos. 4,436,136 and 4,628,982. A curved portion 38 of the lower bead 24 extends initially upwardly and inwardly from the standoff flange 34 (toward the inner surface 28 of the main slat), and then outwardly and downwardly, to form a downwardly opening cavity 40 at the bottom of the slat. The slat employing such a lower bead configuration provides strength advantages over conventional slats. The shorter standoff flange 34 offers a shorter cantilever to loads suspended from the lower bead. In addition, a curtain employing slats of this design will evidence greater stiffness in the direction of wind loads.

Cavity 40 is advantageously employed in the preferred embodiment of the present invention to retain a sealing strip 42 which is preferably made of an elastomeric material, such as a soft rubber. As depicted, the sealing strip has a rounded bead 44 which is retained in cavity 40 and a lip 46 which extends under at least a portion of standoff flange 34 at the bottom surface of the primary slat 18.

Slats 14 and 16 of FIG. 1 show how the sealing strip 42 seals, in a substantially airtight manner, the space between the slats when the curtain is in its uncoiled position. It is preferred to have the lip 46 of these sealing strips compressed between adjacent slats 14, 16 when the door is closed in order to ensure the integrity of the seal. This is accomplished by uncoiling the curtain in the doorway slightly beyond the point where the bottom slat or rail has made contact with a floor or other bottom surface of the doorway, thereby allowing the slats to "overtravel" downwardly toward the floor, whereby each upper slat carrying a sealing strip will bring weight to bear on the strip and on the standoff flange portion 29 of the upper bead of an adjacent lower slat. This "overtravel" is advantageously achieved in rolling doors having a mechanical power assisted operator, such as a crank or electric motor, wherein the curtain is generally not of the "spring loaded" type.

As indicated previously, upper bead 22 of each of slats 18 is configured to interlockingly and pivotably engage a lower bead 24 of an adjacent upper slat. Because sealing strip 42 carried by lower bead 24 must be allowed to pivot into and out of the space between adjacent slats (compare position of slats 12, 14 with position of slats 14, 16), extension segment 32 of upper bead 22 must have sufficient length to provide a clearance for lower bead 24 and sealing strip 42 within the inner area 23 of upper bead 22. Further, extension segment 32 is preferably of sufficient length such that inner area 23 is larger than a combined height of the curved portion 38 of lower bead 24 and the elastomeric strip 42, whereby a small gap is maintained between an interlocked upper and lower bead when the slats are in the uncoiled, aligned position. Thus, when the curtain 10 is raised and coiled to open the door, each slat moves upwardly a short distance before the lower bead 24 of that slat engages the upper bead 22 of the slat below. As this occurs, the strip 42 between the slats will separate from the surface of the standoff flange 29 of the lower slat. This serves to prevent accelerated or excessive wear on the strip 42 which might otherwise take place due to rubbing between the strip and the lower slat when an upper slat carrying the strip is pivoted relative to the lower slat as the curtain is rotated into a coil. Slat assemblies 12, 14 portray, in FIG. 1, the relative pivoting movement of two adjacent slats as a curtain is in the process of being coiled or uncoiled.

The elongated upper bead 22 of the slat assembly of the present invention provides a further advantage in that, in the uncoiling or lowering of the curtain, adjacent slats are rotated into alignment before the elastomeric sealing strips in the space between the adjacent slats begin being compressed. Without first aligning the slats, compression of the elastomeric strip would cause the curtain to bow within its guiderails (not shown) disposed vertically along the sides of the curtain, the bowing being attributable to an opposing reaction of the slats to the compression of the elastomer. Such bowing creates large drag coefficients within the guides, making the raising (opening, coiling) of the curtain more difficult to accomplish.

The sealing strip 42 retained in each lower bead 24 preferably extends across the entire longitudinal extent of the slat assembly, although if a particular application requires only that a space be maintained between adjacent slats, and where full sealing of the gap is of no benefit in the particular application, the elastomeric strip 42 may be provided in short, spaced segments distributed along the longitudinal extent of each lower bead.

Although many anticipated uses for the slat assembly of the present invention will require the slat assemblies to have additional components, namely backer slats and filler materials, the slat assembly having only a primary slat 18 and a sealing strip 42 will find several uses in improving various characteristics of a curtain and rolling door assembly. Where the sealing strip 42 employed is a soft rubber, a curtain made up of such slats would provide some improvement in thermal insulation, due to the reduction in air infiltration between the slats, and some improvement in noise abatement caused by the vibration of the slats in the curtain.

One particularly advantageous application of the slat assembly comprising the primary slat 18 and sealing strip 42 is to improve the fire safety characteristics of a rolling door. In such an application an elastomer capable of withstanding the high temperatures to which a curtain would be exposed in a fire would be employed as the sealing strip 42 material. The sealing strip would thus remain intact and prevent infiltration of smoke generated by the fire through the joints between the slats. An example of such a material would be a polyimide, although other elastomers and non-elastomeric materials having known resistance to high temperature would also be suitable for this application.

The slat assembly of the present invention may further have a backer slat 48 which is configured to engage primary slat 18 and create a void 100 between the inner surface 28 of web 20 and an inner planar surface 50 of the backer slat 48, which is preferably parallel to inner surface 28 of web 20. Backer slat 48 is preferably constructed of a polymeric or other material having low thermal conductivity and one particularly suitable material which may be employed is polyvinylchloride or PVC. Backer slat 48 has an upper curved portion 52 and a lower curved portion 54. The upper curved portion 52 is designed to engage upper bead 22 in a close fitting manner.

Lower curved portion 54 is preferably designed to curve toward inner surface 28 of primary slat 18 in a spaced-apart relationship to lower bead 24. The space defined between backer slat lower curved portion 54 and lower bead 24 is to be sufficient to accommodate an upper bead 22 and its associated backer slat upper curved portion 52, as seen in FIG. 1. Lower curved portion 54 is depicted as having a rearwardly extending tab 56 which is provided to be retained by the concave recess formed by the lower bead curved portion 38 and standoff flange 34.

Backer slat 48 is further provided with an upper bounding member 58 which extends between backer slat 48 and inner surface 28 of primary slat 18, near upper bead standoff flange 29. Upper bounding member 58 thus defines the upper extent of the void 100. In the depicted preferred embodiments, backer slat 48 is also provided with two pairs of retaining tabs 60, 62 which protrude into void 100 in a substantially parallel orientation to inner surface 50 of the backer slat. The function of these pairs of tabs will be described in further detail in the discussion of the remaining figures.

Turning now to FIG. 3, in one preferred embodiment of the slat assembly of the present invention, a thermal slat 200 adapted for use primarily in a thermally insulative curtain is depicted. Thermal slat 200 comprises a primary slat 18, a backer slat 48, and an elastomeric sealing strip 42, all configured in a manner similar to the slat assembly depicted in FIG. 1. Thermal slat 200 advantageously includes filling the void 100 in the slat assembly with a thermally insulative foam material 202. Foam material 202 may advantageously be a urethane foam which is foamed in place to completely fill the void 100. Other possible candidate materials include foamed polystyrene and fiberglass. The use in the slat assembly of a vinyl (PVC) backer slat 48 to retain the insulative material in combination with the use of an elastomeric sealing strip 42 which seals the gap between adjacent slats and minimizes or substantially eliminates metal-to-metal contact between the slats, results in improved thermal insulation performance in a curtain made up of a plurality of slat assemblies thus configured.

FIGS. 4, 5, and 6 depict various embodiments of the slat assembly according to the present invention which are configured for use in curtains designed to improve acoustical transmittance or reflectance, as desired, at the curtain when the curtain is in its lowered position.

FIG. 4 depicts a first preferred embodiment of a slat assembly 300 configured for use in a curtain which has reduced sound transmission characteristics. Slat assembly 300 comprises a primary slat 18, backer slat 48 and elastomeric sealing strip 42, as in the previously described embodiments. Void 100 in this slat assembly 300 is configured to reduce sound transmission through the slat.

A layer or sheet of acoustical foam 302 is disposed against inner surface 28 of primary slat 18, and is held in place by a first pair of tabs 60 extending from backer slat 48. A wool pile or blanket 304 is retained against the inner planar surface 50 of backer slat 48, and is held in place by the second pair of tabs 62 protruding from backer slat 48. The wool pile 304 may have a thin backer layer 306, the backer layer being held by tabs 62 as depicted. An air space 308 defined by the space between the acoustical foam 302 and wool pile 304 is deliberately left in the void to enhance sound attenuation.

The slat assembly 300 is designed to be employed in a curtain wherein the sound source or the origin of the sound to be attenuated across the curtain is at the side "S" of the slat assembly 300 in FIG. 4. Thus, sound waves travel through the PVC backer slat 48, the wool pile material 304, an empty air space, and then a foam material of good sound absorption characteristics, before reaching the metal primary slat 18. It is to be noted that the elastomeric sealing strip 42 also provides an effective barrier to transmission of sound waves for the space between the slats, as well as preventing sound from being transmitted along the metal primary slats 18 of the curtain.

FIG. 5 depicts an alternative embodiment to the slat assembly of FIG. 4 for use in a curtain employed to reduce sound transmission through the curtain. Slat assembly 400 embodies nearly all of the features of slat assembly 300, with the exception that a second layer or panel of acoustical foam 402 is used in lieu of the wool pile employed in slat assembly 300. In this embodiment, the second pair of tabs 62 shown in FIG. 4 embodiment are also preferably eliminated in this FIG. 5 embodiment when the foam panel 402 is prefabricated to be inserted into the backer slat, as the tabs would interfere with proper installation of the foam panel 402.

FIG. 6 depicts a slat assembly 500 which is intended for use in a rolling door curtain in applications where it is desired to enhance the absorption of sound waves by the curtain. As in the embodiments depicted in FIGS. 4 and 5, the origin of the sound is at side "S" of the slat, nearest the PVC backer slat 48. Void 100 in the FIG. 6 embodiment is provided with three layers of materials to generate the desired acoustical properties in the curtain. A layer of acoustical foam 502 is held in place against the inner surface 28 of the primary slat by retaining tabs 60. A wool pile material 504 is disposed and held against the inner planar surface 50 of backer slat 48 by retaining tabs 62. Hardboard member 506 is disposed between the pairs of retaining tabs 60, 62 extending in the space between foam layer 502 and wool pile 504. The addition of the hardboard member increases the acoustical insulation characteristics across this space between the wool pile 504 and the foam layer 502. Hardboard member 506 may be constructed of dense wood or other dense media, including rigid vinyl.

Further improvement in sound absorption may be achieved by employing a perforated primary slat 18', having spaced perforations 510 disposed along the web 20 of the slat. This perforated slat and a rolling door assembly incorporating this perforated slat is the subject of copending application Ser. No. 063,239, filed June 17, 1987. Although not shown in detail, it may be readily appreciated that the perforations 510 preferably are substantially evenly spaced on web 20' along the entire longitudinal extent of the slat, as well as along the entire vertical (as shown) extent of the web. The perforated slat 18' provides less of a solid barrier than does a solid slat, thereby causing less reflection back to side S' of the slat where the sound is originated.

Further improvements in the acoustical performance of a rolling door curtain may be attained by constructing the primary slats 18, 18' of the material depicted in FIG. 7.

As shown in this exploded view of a portion of the planar web 20 of the slat, the slat material 700 is a laminate comprising a first and a second layer of metal 702, 704 sandwiching a thin (approximately 0.004 in.) viscoelastic compound or plastic layer 706. An example of this type of material is marketed under the trademark "Antiphon MPM" (Metal-plastic-metal), by Antiphon, Inc., having sales and marketing offices in Bloomfield Hills, Michigan. This MPM material is known to provide noise damping of structure borne sound, and is advantageously used in the slat assembly of the present invention where transmission of sound through the curtain is to be minimized.

The plastic interlayer 706 effectively damps vibrations occurring at either of layers 702, 704 which are caused by structural vibrations transmitted to the material directly or induced in the metal layers by airborne noise, by converting the vibrational energy into heat. The plastic layer can reduce sound transmissions with efficiencies approximating 80%. Solid materials, such as a solid metal slat, are far less capable of providing such noise damping.

The MPM material provides further advantages when employed as the material making up the primary slat 18 of the slat assembly of the present invention. The MPM material is believed to provide a stronger construction for the slat over an solid metal slat having a thickness equivalent to the metal thickness in the MPM slat. Additionally, different metals may be employed on either side of the plastic interlayer 706. This allows the use of, for example, a high grade alloy such as stainless steel or aluminum to be used on the outer exposed surface 726 of the slat, and a lower grade, less expensive alloy at the hidden inner surface 728 of the slat.

The preferred embodiments described above are presented primarily for illustrative purposes, and various modifications and adaptations may be made without departing from the spirit and scope of the present invention. The scope of the present invention is therefore to be determined by reference to the appended claims.

We claim:

1. A slat assembly for use in a curtain of interlocking slats in a rolling door assembly comprising:

a primary slat, said primary slat further comprising;

a web portion having a longitudinal extent, an outer surface, an inner surface, an upper edge and a lower edge;

an integral upper bead disposed inwardly of said outer surface of said web, said upper bead being joined to said web at said upper edge thereof along the entire longitudinal extent of the web, said upper bead having an upper curved portion; and an integral lower bead disposed inwardly of said outer surface of said web, said lower bead being joined to said web at said lower edge thereof along the entire longitudinal extent thereof, said lower bead having a curved portion, said curved portion forming a downwardly opening cavity extending along said longitudinal extent of said web; wherein an upper surface of said curved portion of said lower bead is shaped to corresponding geometry to an inner surface of said curved portion of said upper bead, wherein said upper curved portion of said upper bead is so constructed and arranged to pivotably engage said upper surface of a lower bead of a first adjacent slat to be disposed above said primary slat when said curtain is constructed, and said upper surface of said lower bead is so constructed and arranged to be pivotably engaged within an upper bead of a second adjacent slat to be disposed below said primary slat when said curtain is constructed; and wherein said slat assembly further comprises seal means for sealing a space between a lower extent of said primary slat and an upper extent of said second adjacent slat to be disposed below said slat assembly, said seal means being retained in said downwardly opening cavity of said lower bead.

2. A slat assembly as defined in claim 1 wherein said lower bead is joined to said web by a standoff flange extending substantially perpendicularly inwardly away from said inner surface of said web.

3. A slat assembly as defined in claim 1 wherein said seal means comprises an elastomeric strip having a bead portion adapted to be retained in said cavity and a lip portion adapted to extend below said lower extent of said primary slat.

4. A slat assembly as defined in claim 3 further comprising a backer slat adapted to engage said primary slat, said backer slat and said inner surface of said web portion of said primary slat defining a void in said slat assembly

5. A slat assembly as defined in claim 4 wherein said backer slat is made of a polyvinyl chloride material

6. A slat assembly as defined in claim 4 wherein said void is substantially completely filled with a foam material having low thermal conductivity

7. A slat assembly as defined in claim 4 wherein said void contains means for reducing transmission of sound through said slat assembly.

8. A slat assembly as defined in claim 7 wherein said sound transmission reducing means comprises at least a first layer of an acoustical foam material disposed adjacent to said inner surface of said web portion of said primary slat.

9. A slat assembly as defined in claim 8 wherein said sound transmission reducing means further comprises a layer of wool pile disposed adjacent to said backer slat, and wherein said wool pile and said layer of acoustical foam material are spaced apart to define an air space therebetween in said void.

10. A slat assembly as defined in claim 8 wherein said sound transmission reducing means further comprises a second layer of acoustical foam material disposed adjacent to said backer slat, and wherein said first and said second layers of acoustical foam material are spaced apart to define an air space therebetween in said void.

11. A slat assembly as defined in claim 7 wherein said primary slat is a laminate comprising a first and a second metal layer and a layer of visco-elastic material sandwiched and bonded between said first and second metal layers.

12. A slat assembly as defined in claim 4 wherein said void contains means for improving absorption of sound from said slat assembly.

13. A slat assembly as defined in claim 12 wherein said sound absorption improving means comprises a layer of acoustical foam material disposed adjacent to said inner surface of said web portion of said primary slat, a layer of wool pile disposed adjacent to said backer slat, and a hardboard member disposed between said foam layer and said wool pile layer.

14. A slat assembly as defined in claim 12 wherein said web portion of said primary slat contains small, closely spaced perforations extending substantially completely along said longitudinal and vertical extent thereof.

15. A slat assembly as defined in claim 4 wherein said backer slat has an upper curved portion adapted to engage said upper bead of said primary slat, a lower curved portion adapted to engage said lower bead of said primary slat, said lower curved portion of said backer slat being spaced apart from said curved portion of said lower bead at a distance sufficient to allow an upper bead of an adjacent slat assembly to be received in said space; and a substantially planar surface extending between said upper and lower curved of said backer slat portions, said planar surface being oriented in a substantially parallel relation to said web portion of said primary slat.

16. A slat assembly as defined in claim 15 wherein said backer slat further comprises an upper bounding member extending forwardly from said backer slat to said inner surface of said web portion of said primary slat near said upper edge of said primary slat.

17. A slat assembly as defined in claim 16 wherein said backer slat further comprises at least a first pair of upper and lower retaining tabs adapted to hold a layer of material to be disposed in said void adjacent to said inner surface of said web portion.

18. A slat assembly as defined in claim 17 wherein said backer slat further comprises a second pair of upper and lower retaining tabs adapted to hold a layer of material to be disposed in said void adjacent to said planar surface of said backer slat.

19. A slat assembly as defined in claim 18 wherein said void contains means for reducing transmission of sound through said slat assembly, said sound transmission reducing means comprising a first layer of an acoustical foam material retained in a position adjacent to said inner surface of said web portion by said first pair of retaining tabs, a layer of wool pile retained in a position adjacent to said planar surface of said backer slat by said second pair of retaining tabs, and wherein said wool pile and said layer of acoustical foam material are spaced apart and define an air space therebetween in said void.

20. A slat assembly as defined in claim 3 wherein said elastomeric strip is capable of withstanding high temperatures on the order of that experienced by a curtain of a rolling door in a fire.

21. A curtain for use in a rolling door assembly comprising:

a plurality of pivotably engaged slat assemblies, each of said plurality of slat assemblies further comprising:

a primary slat comprising a web portion having an outer surface, an inner surface, an upper edge, and a lower edge, said slat having a longitudinal extent, an integral upper bead disposed inwardly of said outer surface of said web, said upper bead being joined to said web at an upper edge thereof along said longitudinal extent of said web; and an integral lower bead disposed inwardly of said outer surface of said web, said lower bead being joined to said web at said lower edge thereof along said longitudinal extent of said web, said lower bead having a curved portion forming a downwardly opening cavity extending along said longitudinal extent of said web;

wherein said upper bead of each of said plurality of slats has a curved portion having an inner surface pivotably engaging and corresponding in geometry to an upper surface of a lower bead of an adjacent one of said plurality of slats disposed immediately thereabove in said curtain;

and wherein said upper bead of each of said slats overlaps a lower bead of a slat disposed immediately thereabove in an interlocking manner; and wherein each of said plurality of slat assemblies further comprises seal means for sealing a longitudinally extending space between adjacent primary slats on an outer side of said curtain, said seal means being retained in said downwardly opening cavity of said lower bead.

22. A curtain as defined in claim 21 wherein a lower bead of each of said plurality of slat assemblies is joined to said web by a standoff flange extending substantially perpendicularly inwardly away from said inner surface of said web.

23. A curtain for a rolling door assembly as defined in claim 21 wherein said seal means comprises a compressible elastomeric strip having a bead portion adapted to be retained in said cavity and a lip portion adapted to extend along a lower extent of each of said slat assemblies.

24. A curtain for a rolling door assembly as defined in claim 23 wherein said upper bead of each of said plurality of slat assemblies has a curved portion including an elongated segment, wherein each of said upper beads is adapted to pivotably engage and receive in an inner area thereof a lower bead of an adjacent slat having one of said elastomeric strips retained in said downwardly opening cavity of said lower bead.

25. A curtain for a rolling door assembly as defined in claim 24 wherein said inner area of said upper bead is of a size sufficient to allow a predetermined amount of vertical movement of said lower bead and said elastomeric strip received therein when said slat assemblies of said curtain are moved vertically upwardly or downwardly.

26. A curtain for a rolling door assembly as defined in claim 25 wherein each of said plurality of slat assemblies further comprises a backer slat adapted to engage an associated primary slat, and wherein each of said backer slats and an associated inner surface of said web portion of said associated primary slat defines a void in each of said plurality of slat assemblies.

27. A curtain for a rolling door assembly as defined in claim 26 wherein each of said backer slats is made of a polyvinylchloride material.

28. A curtain for a rolling door assembly as defined in claim 27 wherein said void in each of said slat assemblies is filled with a foam material having low thermal conductivity.

29. A curtain for a rolling door assembly as defined in claim 28 wherein said void in each of said slat assemblies contains means for reducing transmission of sound through each of said slat assemblies.

30. A curtain for a rolling door assembly as defined in claim 29 wherein said sound transmission reducing means in each of said voids comprises a first layer of acoustical foam material disposed adjacent to said inner surface of said web portion of said primary slat, a layer of wool pile disposed adjacent to said backer slat, and an air space defined by a space between said layer of acoustical foam material and said layer of wool pile in said void.

31. A curtain for a rolling door assembly as defined in claim 25 wherein each of said primary slats is made of a laminate comprising a first and a second metal layer, and a layer of visco-elastic material sandwiched and bonded between said first and said second metal layers.

32. A curtain for a rolling door assembly as defined in claim 29 wherein each of said primary slats is made of a laminate comprising a first and a second metal layer, and a layer of visco-elastic material sandwiched and bonded between said first and said second metal layers.

33. A curtain for a rolling door assembly as defined in claim 27 wherein said void in each of said slat assemblies contains means for improving absorption of sound from each of said slat assemblies.

34. A curtain for a rolling door assembly as defined in claim 33 wherein said sound absorption improving means in each of said voids comprises a layer of acoustical foam disposed adjacent to said inner surface of said web portion of said primary slat, a layer of wool pile disposed adjacent to said backer slat, and a hardboard member disposed between said foam layer and said wool pile layer.

35. A curtain for a rolling door assembly as defined in claim 34 wherein said web portion of each of said primary slats contains small, closely spaced perforations extending substantially completely along said longitudinal and vertical thereof.

36. A curtain for a rolling door assembly as defined in claim 23 wherein said elastomeric strip is made of a material capable of withstanding high temperatures on the order of those experienced by said curtain during fires.

* * * * *

UNITED STATES PATENT AND TRADEMARK OFFICE

CERTIFICATE OF CORRECTION

PATENT NO. : 4,979,553

DATED : December 25, 1990

INVENTOR(S) : John A. Lowry, III, et al

It is certified that error appears in the above-identified patent and that said Letters Patent is hereby corrected as shown below:

Column 10:

Claim 15, line 11 should be --curved portions of said backer slat--.

Signed and Sealed this

Thirteenth Day of October, 1992

*Attest:*

DOUGLAS B. COMER

*Attesting Officer*

*Acting Commissioner of Patents and Trademarks*